US008217749B2

(12) United States Patent
Ikezawa

(10) Patent No.: US 8,217,749 B2
(45) Date of Patent: Jul. 10, 2012

(54) COIL COMPONENT, TRANSFORMER, SWITCHING POWER SUPPLY UNIT, AND METHOD FOR MANUFACTURING COIL COMPONENT

(75) Inventor: Akira Ikezawa, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/723,188

(22) Filed: Mar. 12, 2010

(65) Prior Publication Data

US 2010/0237977 A1 Sep. 23, 2010

(30) Foreign Application Priority Data

Mar. 19, 2009 (JP) ..... P2009-068200

(51) Int. Cl.
*H01F 27/28* (2006.01)
*H01F 21/02* (2006.01)
*H01F 17/04* (2006.01)

(52) U.S. Cl. ..... 336/232; 336/145; 336/182; 336/220; 336/221; 336/222

(58) Field of Classification Search ..... None
See application file for complete search history.

(56) References Cited

U.S. PATENT DOCUMENTS

| | | | | |
|---|---|---|---|---|
| 5,598,135 | A * | 1/1997 | Maeda et al. | 336/200 |
| 5,726,615 | A * | 3/1998 | Bloom | 336/83 |
| 5,886,610 | A * | 3/1999 | Canova | 336/83 |
| 6,087,922 | A * | 7/2000 | Smith | 336/223 |
| 6,489,787 | B1 * | 12/2002 | McFadden | 324/725 |
| 7,408,436 | B2 * | 8/2008 | Ikezawa | 336/208 |
| 2003/0052767 | A1 * | 3/2003 | Yamanobe et al. | 336/232 |
| 2004/0070480 | A1 | 4/2004 | Nakashima et al. | |
| 2008/0239759 | A1 | 10/2008 | Nakahori | |
| 2008/0297297 | A1 * | 12/2008 | Lin et al. | 336/107 |

FOREIGN PATENT DOCUMENTS

| | | | |
|---|---|---|---|
| EP | 1 536 436 | A1 | 6/2005 |
| JP | A-10-149931 | | 6/1998 |
| JP | A-2000-173840 | | 6/2000 |
| JP | A-2003-124040 | | 4/2003 |
| JP | 2003-272934 | A * | 9/2003 |
| JP | A-2005-217311 | | 8/2005 |
| JP | A-2008-253113 | | 10/2008 |
| WO | WO 2007/132558 | A1 | 11/2007 |

OTHER PUBLICATIONS

Jul. 5, 2011 European Search Report issued in European Patent Application No. 10156822.8.

* cited by examiner

*Primary Examiner* — Anh Mai
*Assistant Examiner* — Mangtin Lian
(74) *Attorney, Agent, or Firm* — Oliff & Berridge, PLC

(57) ABSTRACT

A coil component includes coil windings, and resin portions that are insulating members having electrical insulation properties and integrally formed with the coil windings covering parts of surfaces of the coil windings, and the coil component is sandwiched by magnetic core members in directions of winding axes of the coil windings. The coil windings are composed of a plurality of plate-like coil members in a ring shape having ends joined in a stacking direction with a clearance therebetween to be continuous in a predetermined winding direction. The resin portions that are the insulating members cover outermost plate surfaces of the coil members facing the magnetic core members, a space between the adjacent coil members, and inner perimeter edges of the coil members, and have openings along the directions of winding axes of the coil windings.

3 Claims, 10 Drawing Sheets

COIL COMPONENT, TRANSFORMER, SWITCHING POWER SUPPLY UNIT, AND METHOD FOR MANUFACTURING COIL COMPONENT

BACKGROUND OF THE INVENTION

1. Field of the Invention

The present invention relates to a coil component, a transformer, a switching power supply unit, and a method for manufacturing a coil component.

2. Related Background Art

As a component installed in an automobile, there is known a switching power supply unit such as a DC-DC converter for converting a high voltage to a low voltage or converting a low voltage to a high voltage. As a coil component used for a switching power supply unit, for example, there is one known as disclosed in Japanese Patent Application Publication No. JP-A-2005-217311. The coil component disclosed in JP-A-2005-217311 has a coil winding and a tubular coil bobbin having electrical insulation properties that is inserted inside the coil winding.

SUMMARY OF THE INVENTION

In order to construct the coil component disclosed in JP-A-2005-217311, it is necessary to prepare the coil winding and the tubular coil bobbin separately and then insert the coil bobbin inside the coil winding. In other words, the number of components is large and their assembling work is required.

In view of the problems described above, an object of the present invention is to provide a coil component that allows the number of steps required for assembling to be reduced, a transformer and a switching power supply unit using the coil component, and a method for manufacturing the coil component.

According to a first aspect of the present invention, a coil component includes a coil winding, and an insulating member having electrical insulation properties and integrally formed with the coil winding so as to cover a part of a surface of the coil winding, the coil component being sandwiched by magnetic core members in a direction of winding axis of the coil winding, in which the coil winding is composed of a plurality of plate-like coil members in a ring shape having ends joined together in a stacking direction with a clearance therebetween so as to be continuous in a predetermined winding direction, and the insulating member covers outermost plate surfaces of the coil members facing the magnetic core members, a space between the adjacent coil members, and inner perimeter edges of the coil members, and has a portion defining an opening along the direction of winding axis of the coil winding.

With the coil component, out of the surfaces of the coil winding, the outermost plate surfaces of the coil members facing the magnetic core members, the space between the adjacent coil members, and the inner perimeter edges of the coil members are covered with an insulating material. Accordingly, the insulation of the coil winding to the magnetic core members sandwiching the coil component and the insulation between the adjacent coil members are achieved. Since the insulating material is integrally formed with the coil winding, the insulation of the coil winding can be achieved by using the coil component alone, which allows, compared to a conventional case where a coil bobbin is inserted inside the coil winding, the number of steps required for assembling to be reduced.

In the coil component, it is preferable that each of the coil members be provided with a protrusion outwardly bulged such that a part of an outer perimeter edge thereof is larger in a radial direction, and a part of a surface of the protrusion be exposed without being covered with the insulating member.

Accordingly, in the coil member, the facts that the protrusion outwardly bulged is provided such that a part of its outer perimeter edge is larger in a radial direction and that a part of the surface of the protrusion is exposed to the outside without being covered with the insulating material can enhance the heat dissipation effect of the coil winding from the exposed portion, for example, by coupling with a heat dissipating member provided outside via a heat conductive member.

In the coil component, circumferential positions of the protrusions provided to the plurality of coil members may differ from one another.

Accordingly, the fact that the circumferential positions of the protrusions provided to the plurality of coil members are different from one another facilitates the disposition of the heat conductive member for the protrusions and heat dissipation therefrom. Further, when forming the coil winding and the insulating material by insert molding, for the purpose of preventing the coil winding from being deformed by a molding pressure (for example, a pressure when injecting resin that is an insulating material into a mold), the coil winding can be mechanically secured with respect to the mold. Consequently, the deformation of the coil winding while being integrally formed can be prevented.

In the coil component, the insulating member may be provided with a convex portion configured to position the corresponding magnetic core member on one surface thereof facing the magnetic core member.

Accordingly, the fact that the convex portion configured to position the magnetic core member is provided on one surface of the insulating member facing the magnetic core member can prevent the occurrence of displacement between the magnetic core member and the coil component.

According to a second aspect of the present invention, a transformer includes any of the coil components described above. In this case, a transformer using the coil component with reduced number of assembling steps can be obtained.

According to a third aspect of the present invention, a switching power supply unit includes any of the coil components described above. In this case, a switching power supply unit using the coil component with reduced number of assembling steps can be obtained.

According to a fourth aspect of the present invention, a method for manufacturing a coil component including a coil winding, and an insulating member having electrical insulation properties and mold formed integrally with the coil winding so as to cover a part of a surface of the coil winding, the coil component being sandwiched by magnetic core members in a direction of winding axis of the coil winding, includes fabricating the coil winding by joining together a plurality of plate-like coil members in a ring shape having ends in a stacking direction with a clearance therebetween so as to be continuous in a predetermined winding direction, and mold forming an electrical insulating material to integrally form the insulating member and the coil winding such that outermost plate surfaces of the coil members facing the magnetic core members, a space between the adjacent coil members, and inner perimeter edges of the coil members are covered and that a portion defining an opening is provided along the direction of winding axis of the coil winding.

Accordingly, the coil component that is mold formed with the electrical insulating material covering, out of the surfaces of the conductive coil winding, the outermost plate surfaces of the coil members facing the magnetic core members, the space between the adjacent coil members, and the inner perimeter edges of the coil members is manufactured. Consequently, the insulation of the coil winding to the magnetic core members sandwiching the coil component and the insulation between the adjacent coil members can be achieved with reduced number of steps required for assembling.

According to the present invention, a coil component that allows the number of assembling steps to be reduced, a transformer and a switching power supply unit using the coil component, and a method for manufacturing the coil component can be provided.

BRIEF DESCRIPTION OF THE DRAWINGS

The invention will be described with reference to the accompanying drawings, wherein like numbers reference like elements.

DESCRIPTION OF THE PREFERRED EMBODIMENTS

Exemplary embodiments of the present invention will now be described in details with reference to accompanying drawings, wherein like numbers reference like elements and their redundant descriptions are omitted.

Coil Component

Figure 1:
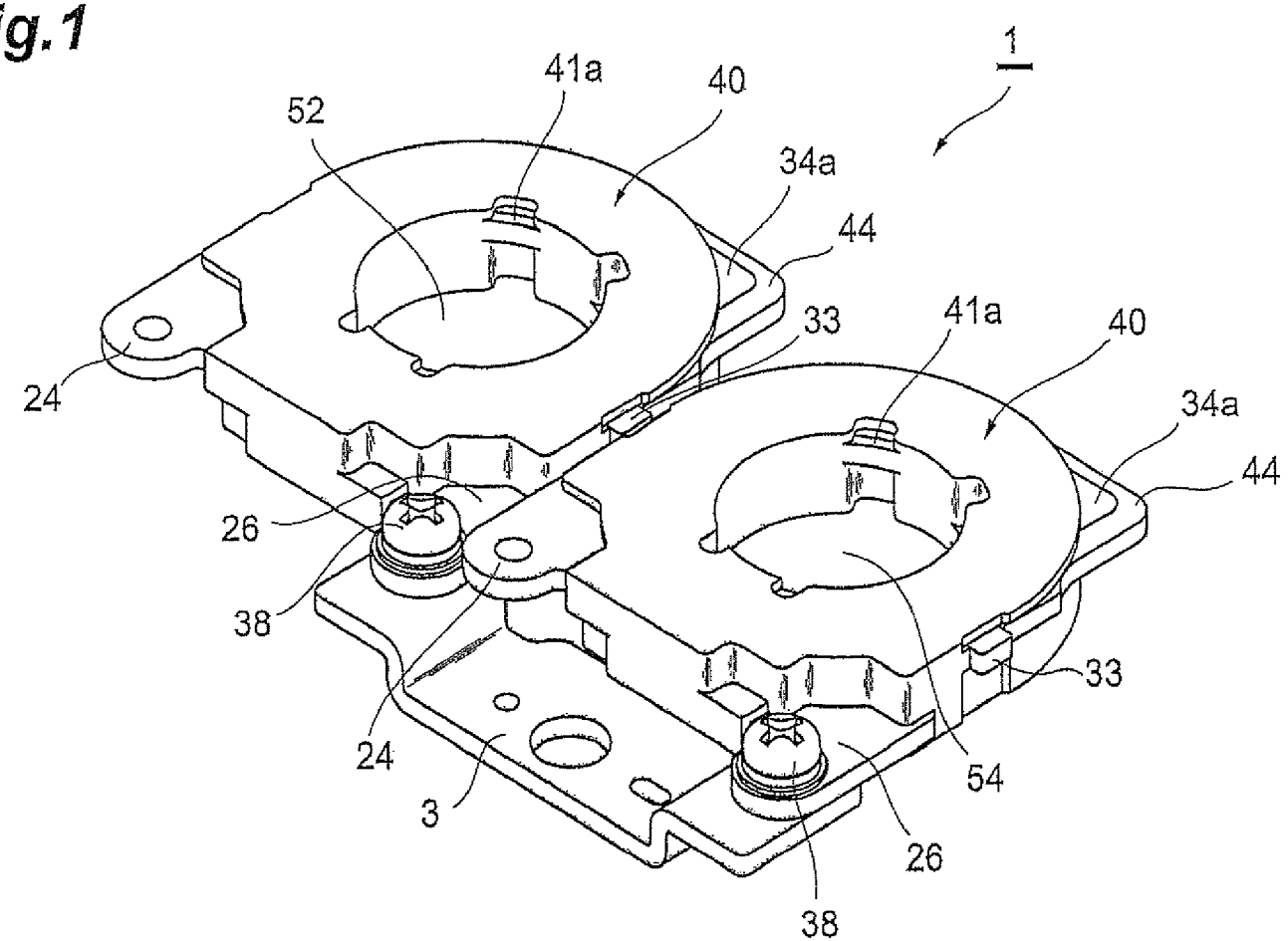
FIG. 1 is a perspective view of a coil component according to an embodiment of the present invention.
Figure 2:
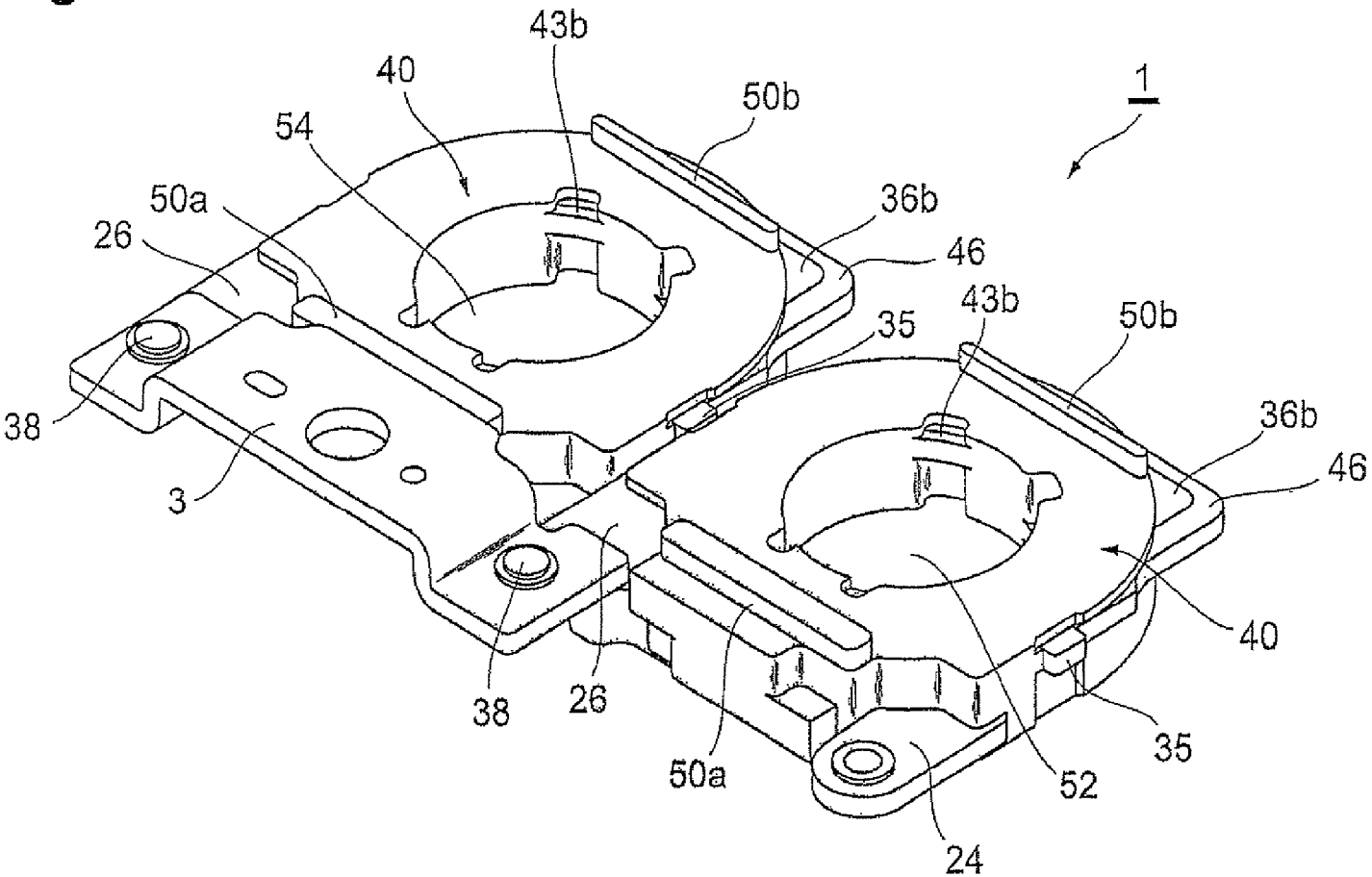
FIG. 2 is a perspective view of the coil component shown in FIG. 1 viewed from the bottom.
Figure 3A:
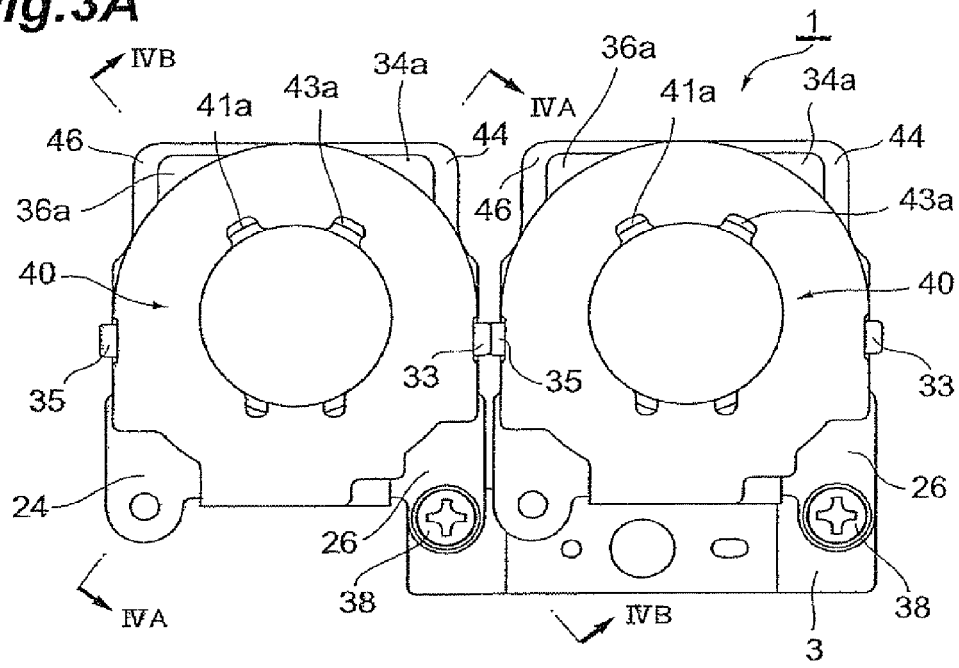
FIG. 3A is a plan view of the coil component shown in FIG. 1.
Figure 3B:
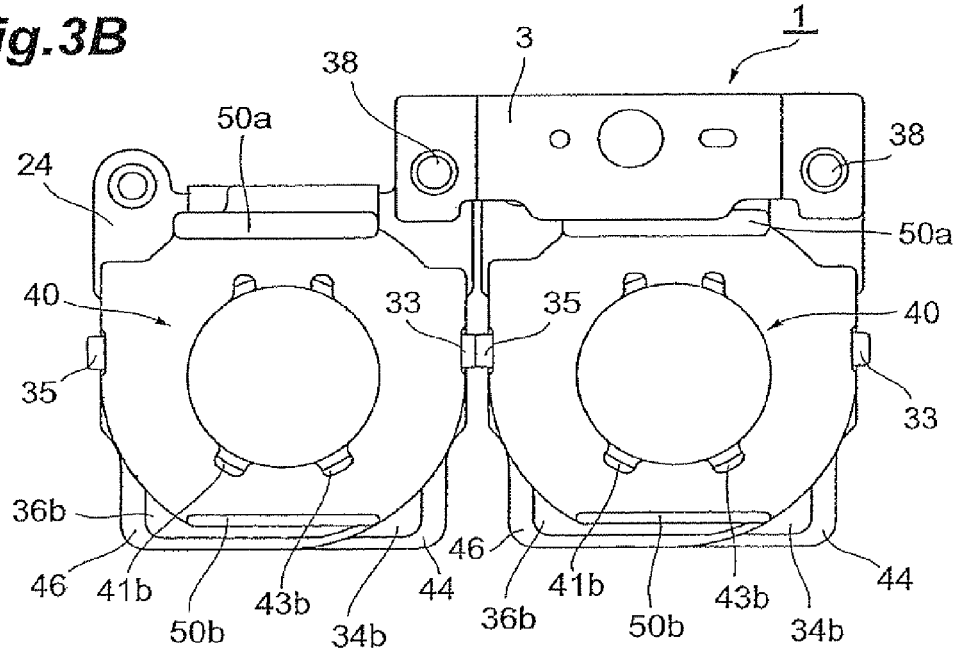
FIG. 3B is a bottom view of the coil component.
Figure 4A:
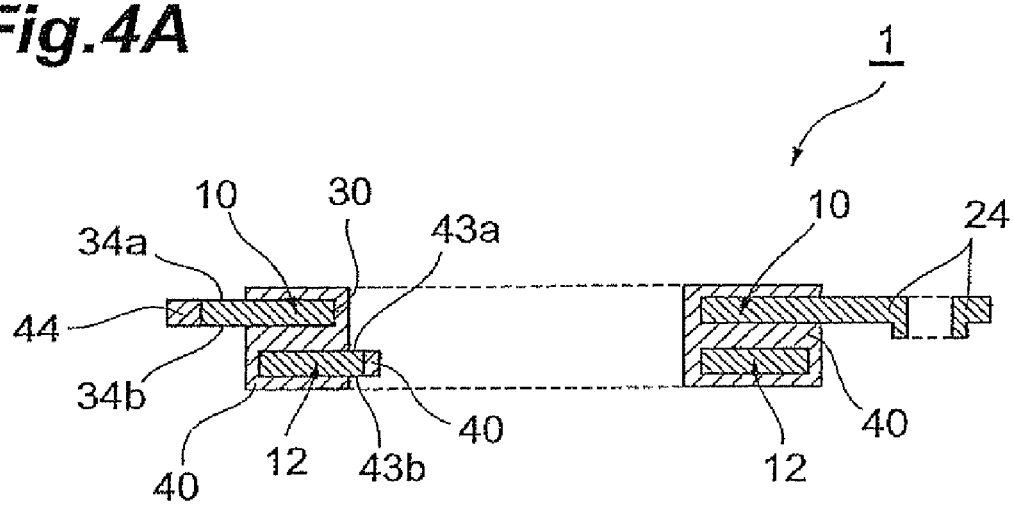
FIG. 4A is a cross-sectional view of the coil component shown in FIG. 3A viewed along the line IV A-IV A.
Figure 4B:
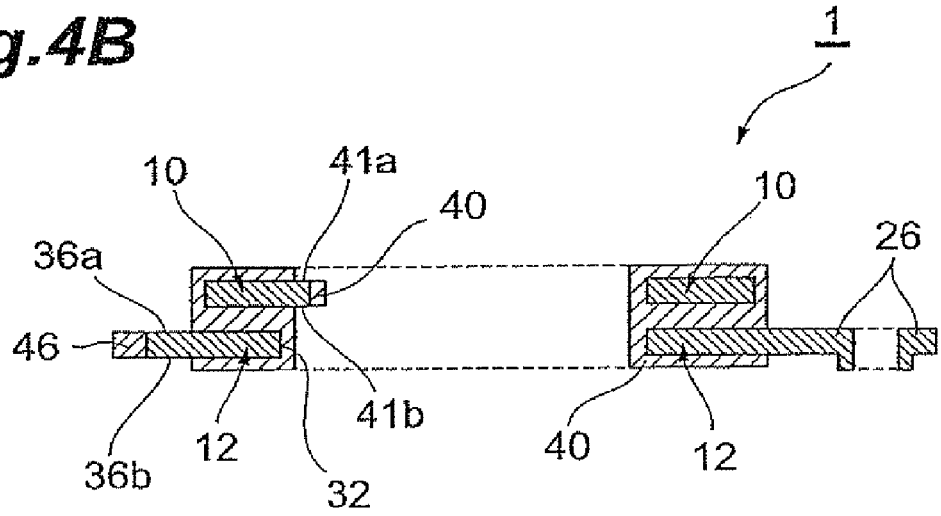
FIG. 4B is a cross-sectional view of the coil component shown in FIG. 3A viewed along the line IV B-IV B.
Figure 5:
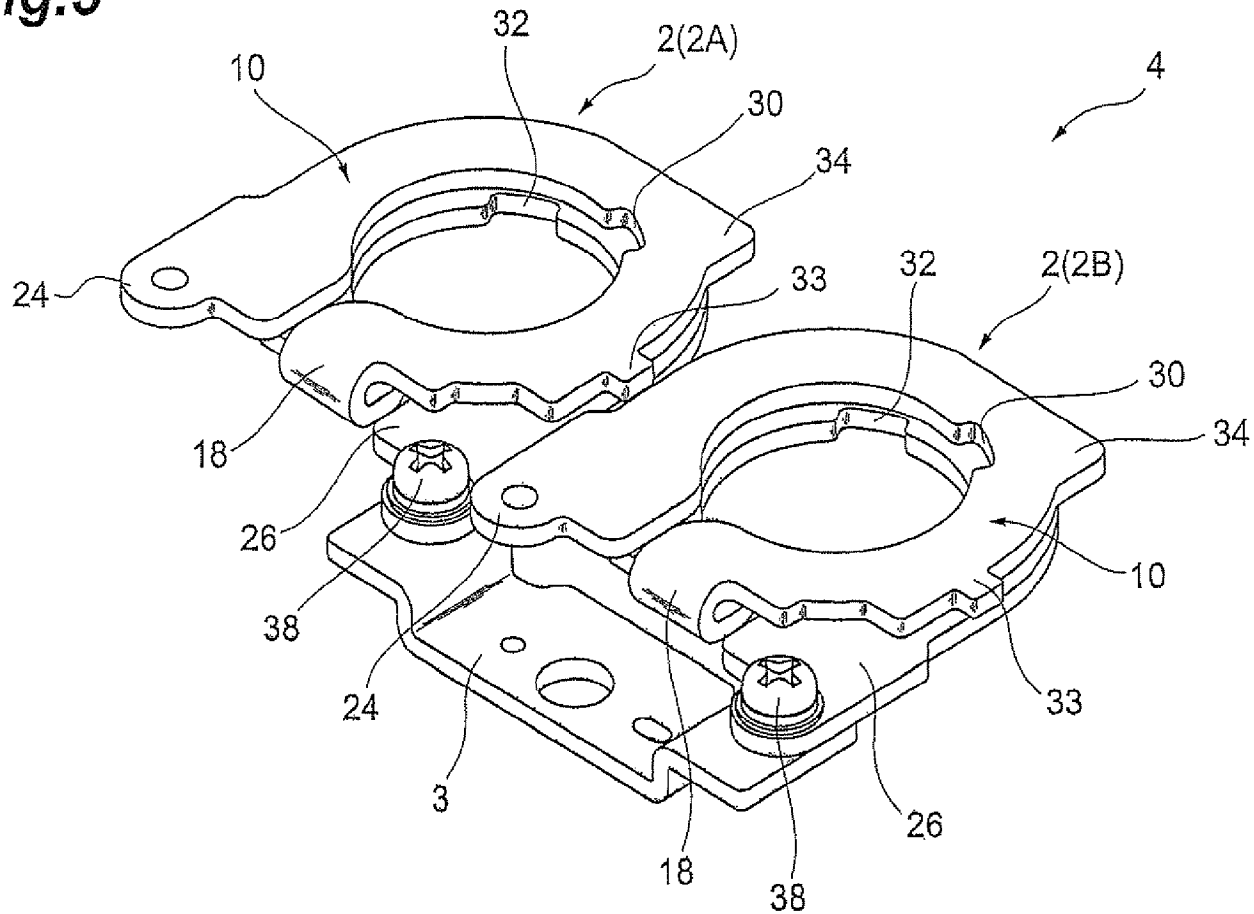
FIG. 5 is a perspective view illustrating a coil winding and a connecting member constituting the coil component shown in FIG. 1.
Figure 6A:
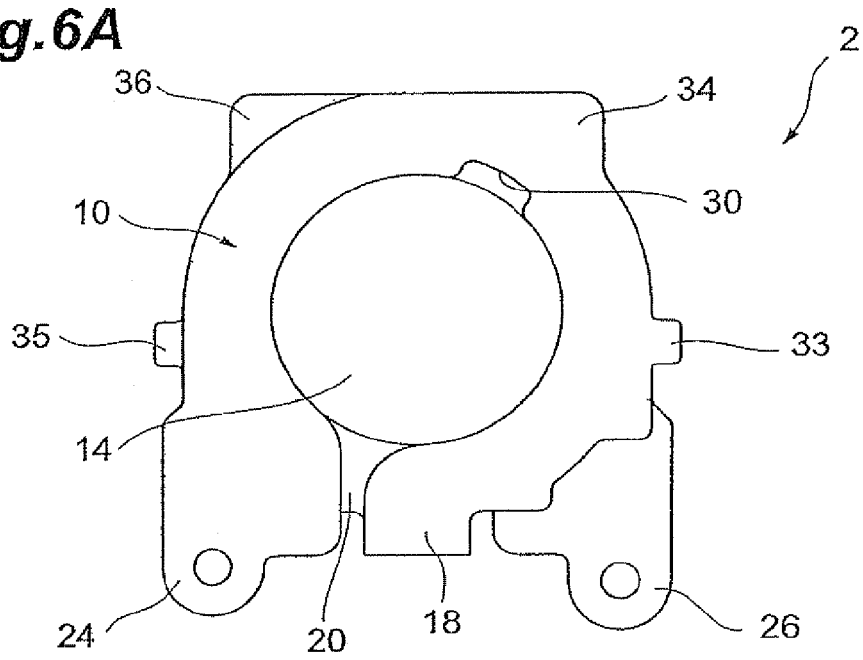
FIG. 6A is a plan view of the coil winding constituting the coil component.
Figure 6B:
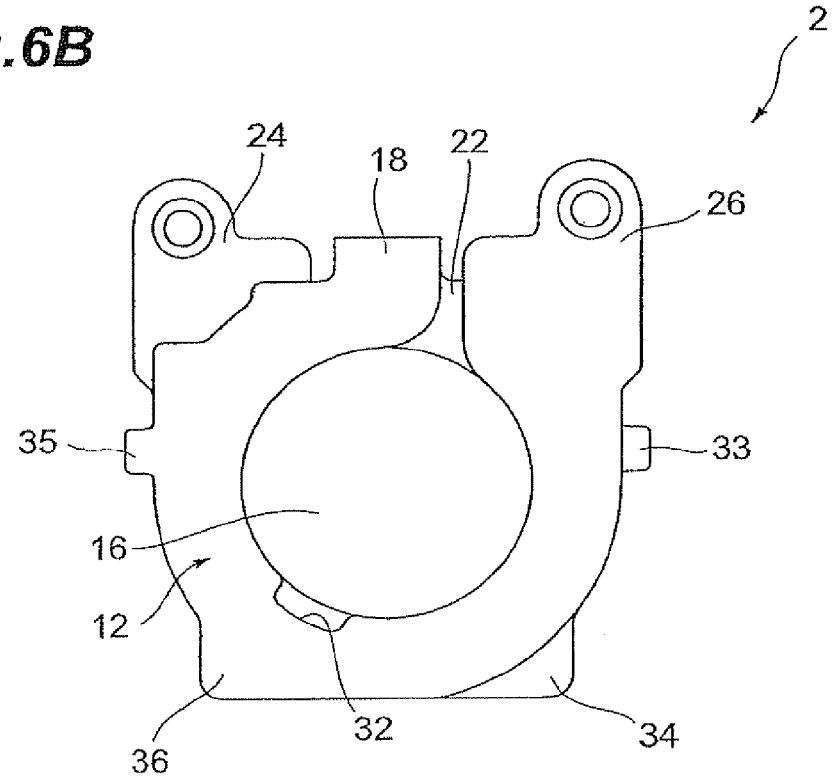
FIG. 6B is a bottom view of the coil winding.
Figure 7:
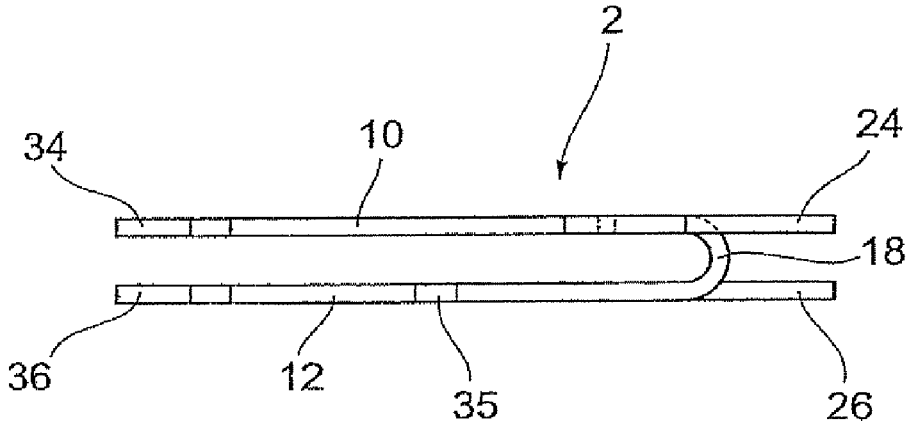
FIG. 7 is a side view of the coil winding.

With reference to FIGS. 1 to 7, the structure of a coil component according to an embodiment of the present invention will be described first. FIG. 1 is a perspective view of the coil component according to the present embodiment. FIG. 2 is a perspective view of the coil component shown in FIG. 1 viewed from the bottom. FIG. 3A is a plan view of the coil component shown in FIG. 1, and FIG. 3B is a bottom view of the coil component shown in FIG. 1. FIG. 4A is a cross-sectional view of the coil component shown in FIG. 3A viewed along the line IV A-IV A, and FIG. 4B is a cross-sectional view of the coil component shown in FIG. 3A viewed along the line IV B-IV B (in FIG. 4B, a coil component 1 is shown without a connecting member 3 being attached). FIG. 5 is a perspective view illustrating a coil winding and a connecting member constituting the coil component shown in FIG. 1. FIG. 6A is a plan view of the coil winding constituting the coil component, and FIG. 6B is a bottom view of the coil winding. FIG. 7 is a side view of the coil winding.

The coil component 1 shown in FIG. 1 is the one used for an inductance element, a switching power supply unit such as a converter or an inverter, a noise filter, and the like. The coil component 1 is structured to include two pieces of coil windings 2 composed of conductive plates, the connecting member 3 configured to connect these two pieces of the coil windings 2 together, and resin portions 40 composed of insulating members having electrical insulation properties and covering the coil windings 2. Now, the coil winding 2 constituting the coil component 1 will be described first, then a structure 4 of the two pieces of the coil windings 2 being connected with the connecting member 3 will be described, and lastly the coil component 1 that is the structure 4 covered with insulating members will be described below.

Coil Winding

The coil winding 2 is, as shown in FIGS. 5 to 7, composed of a first coil member 10 and a second coil member 12 in a ring shape having ends and of plate-like form being juxtaposed to each other with a clearance therebetween and joined together so as to be continuous in a predetermined winding direction.

The first and second coil members 10 and 12 in a ring shape having ends appear as referred to as C-shaped, and have circular openings 14 and 16, respectively, in the center thereof. Between one end and the other end of the first and second coil members 10 and 12, there are slits 20 and 22, respectively, extending from inner circumference to outer circumference thereof. The first coil member 10 and the second coil member 12 are coaxially arranged overlapping with each other such that the openings 14 and 16 are in communication with each other. The first coil member 10 and the second coil member 12 are overlapped such that the positions of the slit 20 and the slit 22 are not aligned (in other words, being not in communication with each other). Accordingly, the other end of the first coil member 10 overlaps with one end of the second coil member 12. The shape of the first and second coil members 10 and 12 is not limited to the shape of a ring having ends appearing as a letter C as described above and, for example, it may take on other shapes such as an oval or a rectangle.

On one end of the first coil member 10, a first terminal 24 is integrally provided outwardly protruding with respect to the center axis of the opening 14. The other end of the first coil member 10 is joined to one end of the second coil member 12 via a U-shaped joining portion 18. On the other end of the second coil member 12, a second terminal 26 is integrally provided outwardly protruding with respect to the center axis of the opening 16.

In the coil winding 2 thus structured, the first terminal 24 is a starting end of the coil winding 2 and the second terminal 26 is a terminating end of the coil winding 2. The power input to the first terminal 24 flows through the first coil member 10, the joining portion 18, and the second coil member 12 in this order, and is output from the second terminal 26.

On the inner perimeter edge of the first coil member 10, a cutout portion 30 where a portion of the first coil member 10 is outwardly cut out is formed. Further, in the area of the outer perimeter edge of the first coil member 10 that is an extension of the line connecting the center axis of the opening 14 and the cutout portion 30, a protrusion 34 where a portion of the first coil member 10 is outwardly bulged is provided such that the outer perimeter edge of the first coil member 10 is larger in a radial direction.

Meanwhile, on the inner perimeter edge of the second coil member 12, a cutout portion 32 where a portion of the second coil member 12 is outwardly cut out is formed. Further, in the area of the outer perimeter edge of the second coil member 12 that is an extension of the line connecting the center axis of the opening 16 and the cutout portion 32, a protrusion 36 where a portion of the second coil member 12 is outwardly bulged is provided such that the outer perimeter edge of the second coil member 12 is larger in a radial direction.

The cutout portions 30 and 32 are pierced through the first and second coil members 10 and 12, respectively, in a thickness direction thereof. When viewed from directions of the center axes of the openings 14 and 16, the cutout portions 30 and 32 have a predetermined width along the circumferences of the openings 14 and 16, respectively, and have a predetermined depth in radial directions of the openings 14 and 16, respectively. The cutout portion 30 provided in the first coil member 10 and the cutout portion 32 provided in the second coil member 12 are, when viewed from the directions of the center axes of the openings 14 and 16, provided at the positions different from each other. The protrusion 34 provided to the first coil member 10 and the protrusion 36 provided to the second coil member 12 have a predetermined width along the outer perimeter edges of the first and second coil members 10 and 12, respectively, and are provided such that the respective outer perimeter edges outwardly protrude by a predetermined width.

The protrusions 34 and 36 are provided at the respective outer perimeter edges that are extensions of the lines connecting the center axes of the openings 14 and 16 to the cutout portions 30 and 32, respectively. Consequently, the widths of the first and second coil members 10 and 12 (width of the conductive plate) in the areas where the respective cutout portions 30 and 32 are formed are ensured, thereby preventing the widths of the first and second coil members 10 and 12 in the peripheries of the respective cutout portions 30 and 32 from being narrow and preventing their respective electrical resistances that cause heat or the like from increasing. In the present embodiment, as described above, the protrusions 34 and 36 are provided to ensure the widths of the first and second coil members 10 and 12 in the areas where the cutout portions 30 and 32 are formed, respectively, thereby preventing an electrical resistance from increasing because of the reduction of cross-sectional areas of the first and second coil members 10 and 12 which are determined by the width and thickness of the conductive plate. The protrusions 34 and 36 are, when viewed from the directions of center axes of the openings 14 and 16, provided at positions different from each other.

The first and second coil members 10 and 12 are further provided with protrusions 33 and 35 that are different from the protrusions 34 and 36, respectively. The protrusion 33 is provided to the outer circumference of the first coil member 10 at a position different from the protrusion 34 (for example, as shown in FIG. 6A, at a position 90 degrees to the joining portion 18 with an axis of winding of the coil winding 2 as a reference). The protrusion 35 is provided to the outer circumference of the second coil member 12 at a position different from the protrusion 36 (for example, as shown in FIG. 6B, at a position −90 degrees to the joining portion 18 with the axis of winding of the coil winding 2 as a reference). As illustrated above, the first and second coil members 10 and 12 may be provided with a plurality of protrusions.

The coil winding 2 structured as described above can be formed by punching a single plate of a high electrical conductivity. More specifically, from a plate of copper, aluminum or the like, the first terminal 24, the first coil member 10 continued from the first terminal 24, the second coil member 12, the second terminal 26 continued from the second coil member 12, and the joining portion 18 in the shape of a letter I joining the first and second coil members 10 and 12 are obtained by punching process. Thereafter, by bending the joining portion 18 in a U-shape, the first coil member 10 and the second coil member 12 are overlapped with a predetermined clearance therebetween. This completes the coil winding 2 composed of a conductive plate. The coil winding 2 is not limited to such a bent coil. For example, the coil member and the joining portion may be screwed, welded or fixed with a rivet.

In the coil component 1 according to the present embodiment, as shown in FIG. 5, the structure 4 of two pieces of the coil windings 2 (2A and 2B) juxtaposed to each other with both of the second terminals 26 being connected together via the connecting member 3 is used. The connecting member 3 and the second terminals 26 of the two pieces of the coil windings 2 are fixed together with respective screws 38. Consequently, the current input to the first terminal 24 of the coil winding 2A flows through the first coil member 10, the joining portion 18, and the second coil member 12 in this order and up to the second terminal 26 of the coil member 2A. Thereafter, via the connecting member 3, the current is fed into the second terminal 26 of the coil winding 2B. The current then flows through the second coil member 12, the joining portion 18, and the first coil member 10 of the coil winding 2B in this order, and is output from the first terminal 24 of the coil winding 2B.

Coil Component

Next, the coil component 1 in which insulating members are integrally formed with the two pieces of the coil windings 2 connected together with the connecting member 3 will be described.

As shown in FIG. 1, the coil component 1 is provided with resin portions 40 composed of an insulating material each covering a part of the areas of the first and second coil members 10 and 12 of the two pieces of the coil windings 2. More specifically, the resin portions 40 cover the outermost plate surfaces of the first and second coil members 10 and 12 facing a later-described magnetic core member, a space between the first and second coil members 10 and 12 facing each other, and the inner perimeter edges of the first and second coil members 10 and 12. In the coil component 1 of the present embodiment, the resin portions 40 also cover the outer perimeter edges of the first and second coil members 10 and 12. As for the insulating material used for the resin portions 40, for example, polybutylene terephthalate resin (PBT) and polyphenylene sulfide resin (PPS) are suitably used because of their superior characteristics in heat resistance, chemical resistance, flame resistance, dimensional stability, and the like.

The resin portions 40 cover the surfaces of the first and second coil members 10 and 12 of the two pieces of the coil windings 2, except for the first terminals 24 and the second terminals 26. The resin portions 40 also form openings 52 and 54 in the center along the axes of the first and second coil members 10 and 12 of the coil windings 2. In other words, the coil component 1 has hollow sections similar to the coil members 10 and 12. The openings 52 and 54 are provided such that leg portions of the later-described magnetic core member can be inserted therethrough.

As shown in FIGS. 2 and 3B, on the bottom side of the coil component 1, outwardly protruding convex portions 50*a* and 50*b* formed with the resin portions 40 are provided. They are provided so as to determine the position of a later-described magnetic core member. As shown in FIGS. 4A, 4B and the like, the resin portions 40 are provided to fill the space between the first coil member 10 and the second coil member 12. However, parts of the surfaces of the protrusions 34 and 36 of the coil windings 2, a part of the area of the second coil member 12 corresponding to the cutout portion 30 of the first coil member 10 along the center axes of the openings 14 and 16, and a part of the area of the first coil member 10 corresponding to the cutout portion 32 of the second coil member 12 along the center axes of the openings 14 and 16 out of the surfaces of the coil windings 2 are not covered with the resin portion 40 but are exposed to the outside. Now, these exposed areas of the coil windings 2 will be described below.

In the protrusions 34 and 36 of the coil windings 2, the surfaces perpendicular to the center axes of the openings 14 and 16 (i.e., surfaces 34*a*, 34*b*, 36*a* and 36*b* shown in FIGS. 3A and 3B) out of the surfaces thereof are exposed to the outside, while the outer perimeter edges of the protrusions 34 and 36 are covered with resin portions 44 and 46, respectively. Because of the parts of the surfaces of the protrusions 34 and 36 being exposed to the outside, for example, by coupling with a heat dissipating member provided outside with a member having heat conductivity interposed therebetween in an electrically insulated manner, the heat from the coil windings 2 can be dissipated from the exposed areas. Because of the outer perimeter edges of the protrusions 34 and 36 being covered with the resin portions 44 and 46, respectively, the insulation of the coil component 1 to other devices and the like disposed in its periphery can be ensured when they contact. Since the outer circumferences of the coil windings 2 are covered with the resin portions 40 and the outer perimeter edges of the protrusions 34 and 36 are covered with the resin portions 44 and 46, respectively, when the coil component 1 is structured with two pieces of the coil windings 2 covered with the resin portions 40 and juxtaposed to each other, as in the present embodiment, the insulation between the two pieces of the coil windings 2 in the coil component 1 can be ensured.

In the coil component 1 as described above, a part of the area of the second coil member 12 corresponding to the cutout portion 30 of the first coil member 10 along the center axes of the openings 14 and 16 and a part of the area of the first coil member 10 corresponding to the cutout portion 32 of the second coil member 12 along the center axes of the openings 14 and 16 are exposed to the outside. More specifically, as shown in FIGS. 1, 3 and 4, the cutout portion 30 is also covered with the resin portion 40 of the thickness similar to that of other parts of the inner perimeter edge. Accordingly, as shown in FIG. 4A, the area of the second coil member 12 corresponding to the cutout portion 30 of the first coil member 10 along the center axes of the openings 14 and 16 protrudes further inwards of the inner perimeter edge compared to the cutout portion 30 covered with the resin portion 40. The parts of the protruding area that are a front surface 43*a* and a rear surface 43*b* (area of the second coil member 12 corresponding to the cutout portion 30 of the first coil member 10) are thus exposed to the outside. The insides (inner perimeter portions) of the front surface 43*a* and the rear surface 43*b* exposed to the outside are covered with the resin portion 40, as shown in FIG. 4A, similar to the other portions of the inner perimeter edges of the first and second coil members 10 and 12. Accordingly, the entire edges of the inner perimeters of the openings 52 and 54 of the coil component 1 are covered with the resin portions 40. Consequently, the insulation between the coil windings 2 and the magnetic core member inserted to the openings 52 and 54 can be ensured.

Further, the area of the first coil member 10 corresponding to the cutout portion 32 of the second coil member 12 along the center axes of the openings 14 and 16 is formed likewise. More specifically, similar to the area of the second coil member 12 corresponding to the cutout portion 30 of the first coil member 10 described above, as shown in FIG. 4B, the area of the first coil member 10 corresponding to the cutout portion 32 of the second coil member 12 protrudes further inwards of the inner perimeter edge compared to the cutout portion 32. The parts of the protruding areas that are a front surface 41*a* and a rear surface 41*b* are exposed to the outside. The insides (inner perimeter portions) of the front surface 41*a* and the rear surface 41*b* exposed to the outside are covered, as shown in FIG. 4B, with the resin portion 40 similar to the other portions of the inner perimeter edges of the first and second coil members 10 and 12.

In the coil component 1, the protrusions 33 and 35 provided to the first and second coil members 10 and 12, respectively, constituting the coil windings 2 are completely exposed to the outside (in other words, even the outer perimeter edges of the protrusions are not covered with the resin portions 40). As in the cases of the protrusions 33 and 35, the outer circumference of the areas exposed to the outside and not covered with the resin portions 40 is not necessarily covered with the resin portions 40.

As described in the foregoing, by providing the above-described areas being exposed to the outside (the protrusions 33 and 35, the surfaces 34*a*, 34*b*, 36*a* and 36*b* of the protrusions 34 and 36, and the surfaces 41*a*, 41*b*, 43*a* and 43*b* of the areas corresponding to the cutout portions 30 and 32), compared to the case where those areas are covered with the resin portions 40, the heat of the coil windings 2 can be dissipated to the outside more efficiently.

The coil component 1 can be manufactured, for example, by the method described below. First, two pieces of the coil windings 2 in each of which the first coil member 10 and the second coil member 12 are joined together with the joining portion 18 are prepared. Each of the coil windings 2 is then arranged as an insert component in a mold that is formed in the shape of the resin portion 40 and is molded by injecting resin into the mold to obtain the coil winding 2 in which the parts of the circumferences of the first coil member 10 and the second coil member 12 are integrally formed with the resin portion 40. Then, the second terminals 26 of the two pieces of the coil windings 2 integrally formed with the resin portions 40 are fixed to the electrically conductive connecting member 3 with the screws 38 to complete the coil component 1.

By the molding pressure in molding (i.e., the pressure when injecting resin into the mold), the coil winding 2 may sometimes be deformed and a short-circuiting may occur. However, even though the coil winding 2 is deformed while molding, it is difficult to check if a short-circuiting exists in the coil winding 2 after being integrally molded. For this reason, when forming the coil component 1 according to the present embodiment, for the purpose of preventing the coil winding 2 from being deformed by the molding pressure, the protrusions 34 and 36 provided to the first and second coil members 10 and 12, a part of the area of the second coil member 12 corresponding to the cutout portion 30 of the first coil member 10 along the center axes of the openings 14 and 16, and a part of the area of the first coil member 10 corresponding to the cutout portion 32 of the second coil member 12 along the center axes of the openings 14 and 16 are mechanically secured by the mold. Accordingly, the deformation of the coil winding 2 in molding can be prevented. The areas mechanically secured are not covered with resin and become the areas exposed to the outside (more specifically, the surfaces 34*a*, 34*b*, 36*a* and 36*b* of the protrusions 34 and 36 and the surfaces 41*a*, 41*b*, 43*a* and 43*b* that are the areas corresponding to the cutout portions 30 and 32).

Coil Component with Magnetic Core Members

Figure 8:
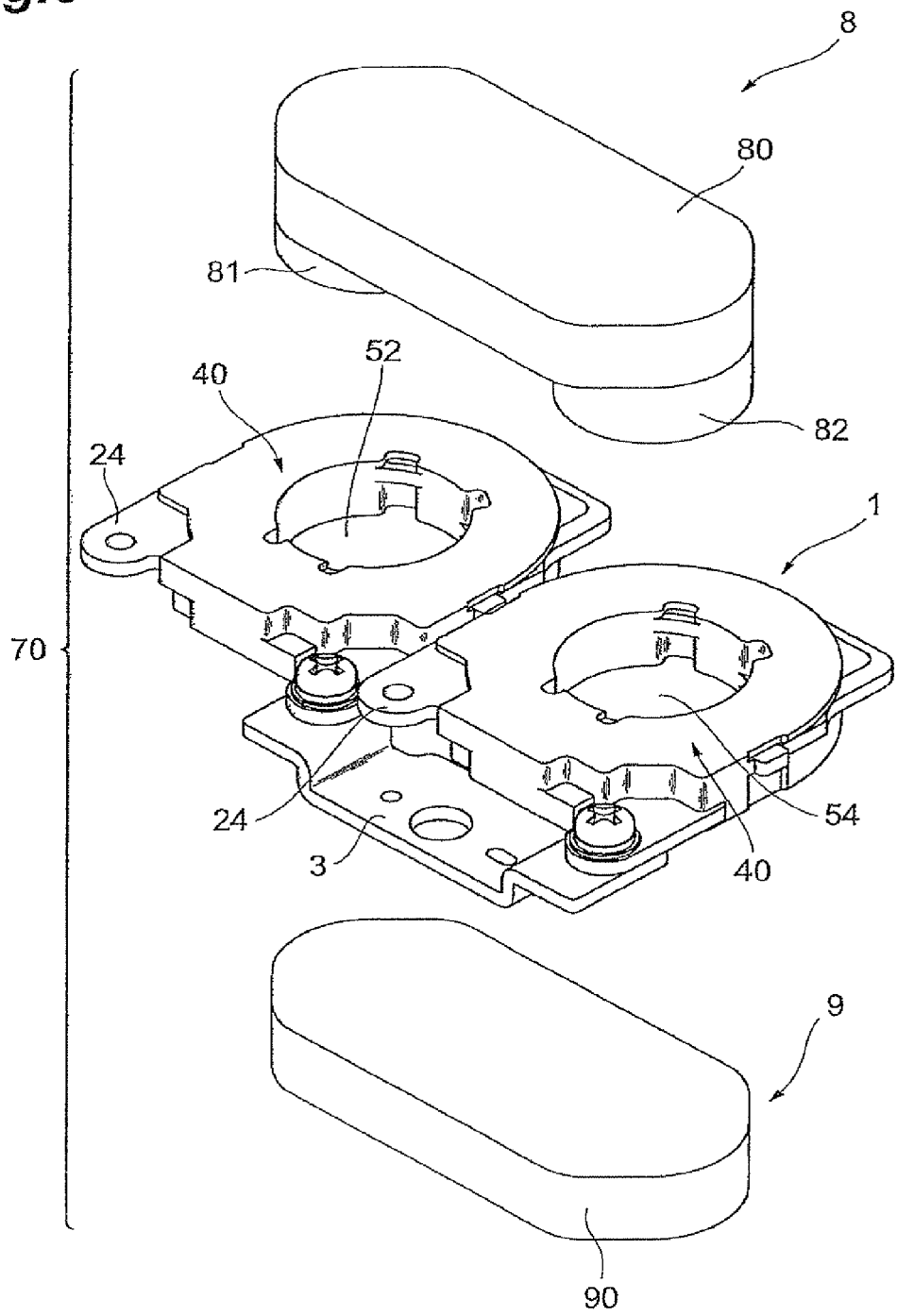
FIG. 8 is an exploded perspective view of a coil component further provided with magnetic core members.

Next, a coil component 70 will be described. The coil component 70 is composed of the coil component 1 further provided with magnetic core members. The coil component 70 functions as, for example, a choke coil for a later-described switching power supply unit. FIG. 8 is an exploded perspective view of the coil component 70 according to the present embodiment.

As shown in FIG. 8, the coil component 70 to which the coil component 1 is suitably applied is provided with the coil component 1 in which the surfaces of the coil windings 2 are covered with the resin portions 40, and a pair of magnetic core members 8 and 9. As shown in FIG. 8, the magnetic core members 8 and 9 are disposed so as to sandwich the coil component 1 along the center axes of the openings 52 and 54 of the coil component 1. The coil component 70 is structured such that, under the condition of being sandwiched by the pair of magnetic core members 8 and 9, the first and second terminals 24 and 26 and the connecting member 3 protrude from the magnetic core members 8 and 9.

The magnetic core members 8 and 9 are a combination of so-called U-shaped core and I-shaped core, respectively, and are obtainable by powder compacting ferrite powders. More specifically, the magnetic core member 8 is composed of a flat plate-like base 80 having a longitudinal direction, and two pieces of cylindrical leg portions 81 and 82 protruding from one of the principal surfaces of the base 80. The leg portion 81 and the leg portion 82 are coupled with the base 80 and spaced apart from each other. Meanwhile, the magnetic core member 9 is composed of a flat plate-like base 90 having a longitudinal direction.

The leg portions 81 and 82 of the magnetic core member 8 are inserted into and through the openings 52 and 54, respectively, of the coil component 1. The leg portions 81 and 82 inserted to the openings 52 and 54 abut on the base 90 of the magnetic core member 9.

One of the principal surfaces of the base 80 of the magnetic core member 8 abuts on the resin portions 40 on one of the principal surfaces (upper surface shown in FIG. 1) of the coil component 1. One of the principal surfaces of the base 90 of the magnetic core member 9 abuts on the resin portions 40 on the other of the principal surfaces of the coil component 1 (bottom surface shown in FIG. 2). In this case, by the convex portions 50*a* and 50*b* provided to the resin portions 40 abutting on two facing sides of the base 90 in the longitudinal direction, the positional displacement between the magnetic core member 9 and the coil component 1 in a width direction thereof can be suppressed. While the convex portions 50*a* and 50*b* provided to the resin portions 40 of the coil component 1 according to the present embodiment are formed in rib shapes along the outer circumference of the base 90 in the longitudinal direction, the shapes of the convex portions are not limited as such. For example, a number of convex portions may be provided along the outer circumference of the base 90 including in a widthwise direction or, by providing concave portions to the base 90 and providing the convex portions to the resin portion 40 at the positions corresponding to the concave portions, the abutting positions of the coil component 1 and the magnetic core member 9 may be determined.

Switching Power Supply Unit

Figure 9:
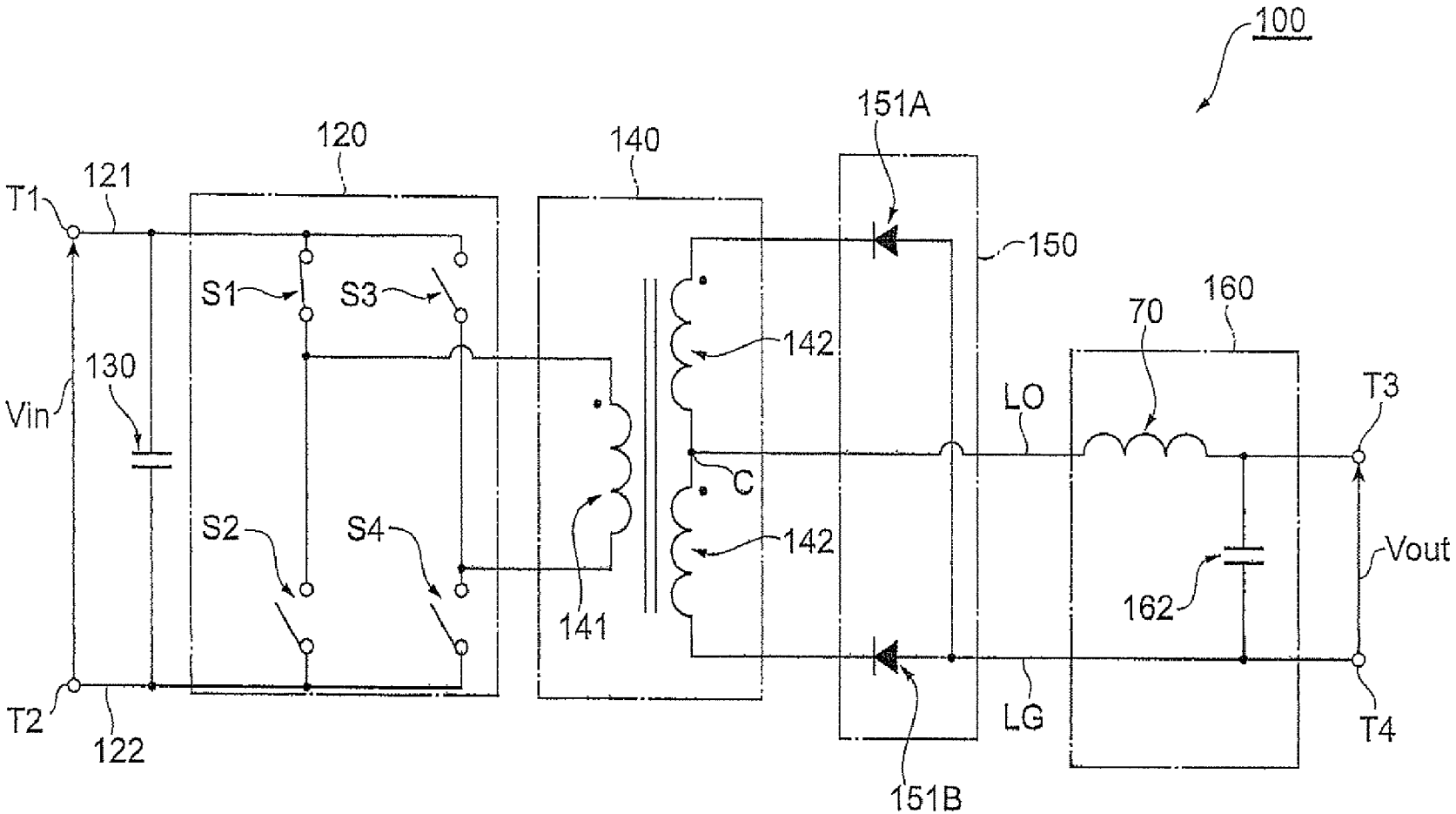
FIG. 9 is a schematic circuit diagram of a switching power supply unit according to an embodiment of the present invention.
Figure 10:
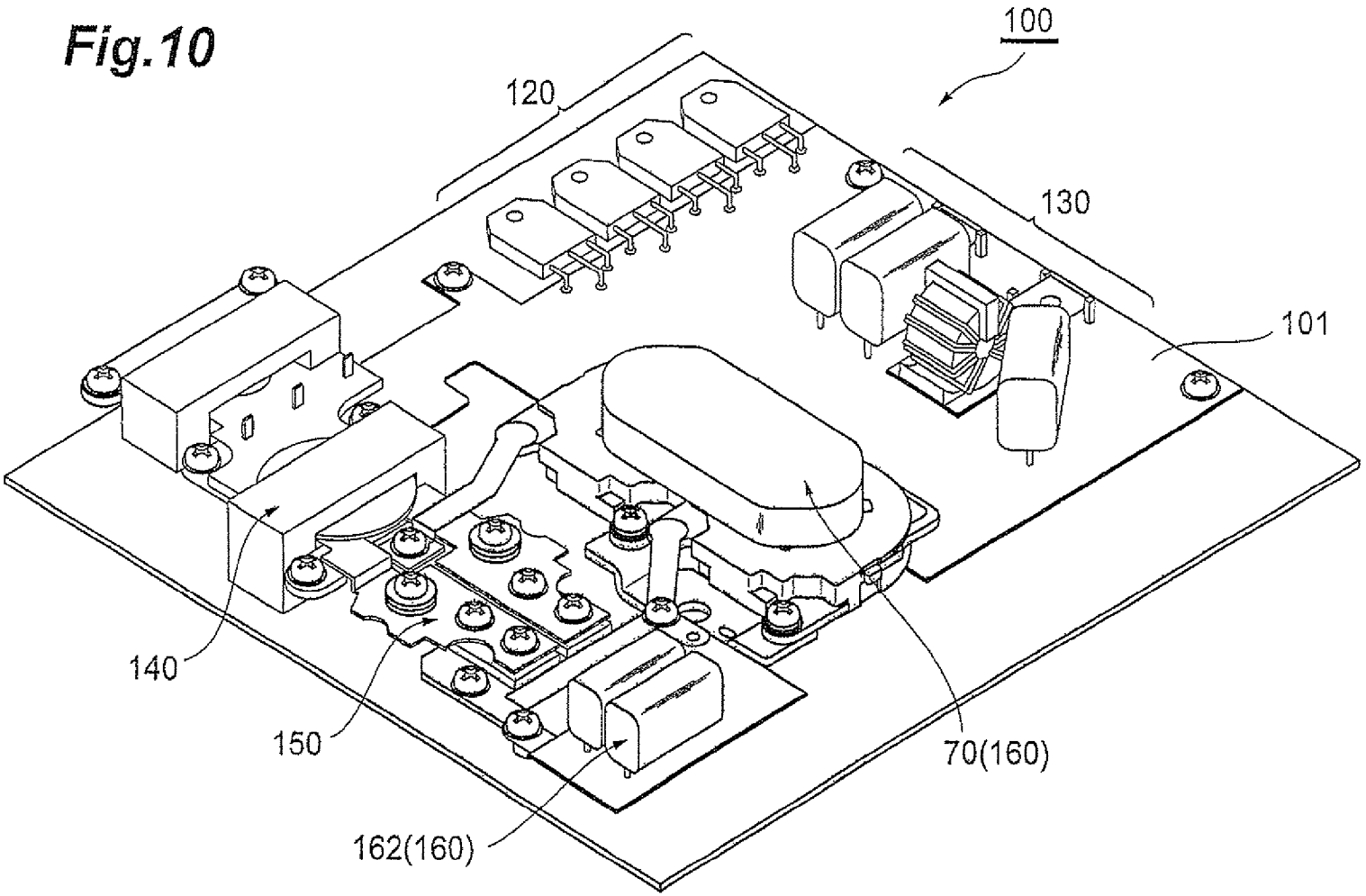
FIG. 10 is a perspective view of the switching power supply unit according to the embodiment.

Next, a switching power supply unit to which the coil component 70 according to the present embodiment is suitably applied will be described below. FIG. 9 is a schematic circuit diagram of a switching power supply unit 100. FIG. 10 is a perspective view of the switching power supply unit 100. The switching power supply unit 100 according to the present embodiment serves as a DC-DC converter and, for example, converts a high DC input voltage Vin that is supplied from a high voltage battery storing a voltage of about 100 to 500 V to a low DC output voltage Vout, and supplies it to a low voltage battery storing a voltage of about 12 to 16 V.

The switching power supply unit 100, as shown in FIG. 10, has a base plate 101 and, on the base plate, an input smoothing capacitor (input filter) 130, a switching circuit 120, a main transformer 140, a rectifier circuit 150, and an output smoothing circuit 160 composed of a choke coil (coil component) 70 and a smoothing capacitor 162 are mounted.

The switching power supply unit 100 is provided with, more specifically, the switching circuit 120 and the input smoothing capacitor 130 provided between a primary high voltage line 121 and a primary low voltage line 122, the main transformer 140 having primary and secondary transformer coil sections 141 and 142, the rectifier circuit 150 connected to the secondary transformer coil section 142, and the smoothing circuit 160 connected to the rectifier circuit 150.

The switching circuit 120 is configured as a full bridge type circuit composed of switching elements S1 to S4. The switching circuit 120 converts, for example, in response to a driving signal provided from a drive circuit (not shown), the DC input voltage Vin applied between input terminals T1 and T2 into an AC input voltage.

The input smoothing capacitor 130 smoothes out the DC input voltage Vin input from the input terminals T1 and T2. The main transformer 140 transforms the AC input voltage produced by the switching circuit 120 and outputs an AC output voltage. The turn ratio of the primary and secondary transformer coil sections 141 and 142 is appropriately set according to the ratio of transformation. Here, the number of turns for the primary transformer coil section 141 is made larger than the number of turns for the secondary transformer coil section 142. The secondary transformer coil section 142 is of a center-tap type and is connected to an output terminal T3 via a connecting terminal C and an output line LO.

The rectifier circuit 150 is of a single-phase full-wave rectification type composed of rectifier diodes 151A and 151B. Cathodes of the rectifier diodes 151A and 151B are each connected to the secondary transformer coil section 142, while anodes thereof are connected to a ground line LG leading to an output terminal T4. Accordingly, the rectifier circuit 150 individually rectifies the AC output voltage output from the main transformer 140 during each half-wave period and produces a DC voltage.

The smoothing circuit 160 is structured to include the choke coil 70 and the output smoothing capacitor 162. The choke coil 70 is provided being inserted in the output line LO. The output smoothing capacitor 162 is connected on the output line LO between the choke coil 70 and the ground line LG. Accordingly, the smoothing circuit 160 smoothes out the DC voltage rectified by the rectifier circuit 150 to produce the DC output voltage Vout and provides the DC output voltage Vout from the output terminals T3 and T4 to a low voltage battery and the like.

In the switching power supply unit 100 thus structured, the DC input voltage Vin supplied from the input terminals T1 and T2 is switched to produce an AC input voltage, and the AC input voltage produced is supplied to the primary transformer coil section 141 of the main transformer 140. Then, the AC input voltage produced is transformed and is output from the secondary transformer coil section 142 as an AC output voltage. The AC output voltage is then rectified by the rectifier circuit 150, smoothed out by the smoothing circuit 160, and output from the output terminals T3 and T4 as the DC output voltage Vout.

As described in the foregoing, in the coil component 1 according to the present embodiment, out of the surfaces of the coil windings 2, the outermost plate surfaces of the coil members 10 and 12 facing the magnetic core members 8 and 9, the space between the adjacent coil members 10 and 12, and the inner perimeter edges of the coil members 10 and 12 are covered with the resin portions 40. Accordingly, the insulation of the coil windings 2 to the magnetic core members 8 and 9 sandwiching the coil component 1 and the insulation between the adjacent coil members 10 and 12 are achieved. As the resin portions 40 that achieve the insulation are integrally formed with the coil windings 2 in the coil component 1, the use of the coil component 1 alone can achieve the insulation of the coil windings 2. Consequently, compared to a conventional case where a coil bobbin is inserted inside the coil winding, the number of steps required for assembling is reduced.

In the coil component 1, the protrusions 34 and 36 outwardly bulged are provided such that the parts of the outer perimeter edges of the coil members 10 and 12, respectively, are larger in the radial direction, and the parts of the surface areas of the protrusions 34 and 36, namely, the surfaces 34*a*, 34*b*, 36*a* and 36*b* are exposed to the outside and not covered with the resin portions 40. Consequently, from these exposed areas, for example, by coupling with a heat dissipating member provided outside via a member having heat conductivity in an electrically insulated manner, the heat dissipation effect of the coil windings 2 can be enhanced.

In the coil component 1, the fact that the circumferential positions of the protrusions 34 and 36 provided to the coil members 10 and 12, respectively, are different from each other facilitates the disposition of a heat conductive member for the protrusions 34 and 36, and heat dissipation therefrom. This structure further allows, when insert molding the coil winding 2 and the material for the resin portion 40, for the purpose of preventing the coil winding 2 from being deformed by the molding pressure as described above, the coil winding 2 to be mechanically secured with respect to the mold. Consequently, the deformation of the coil winding 2 while being integrally formed can be prevented.

In the coil component 1, on the surface facing the magnetic core member 9 on the bottom side, the convex portions 50*a* and 50*b* configured to determine the position of the base 90 of the magnetic core member 9 are provided. Accordingly, the occurrence of displacement between the magnetic core member and the coil component 1 is prevented.

When the coil component 1 is applied to the switching power supply unit 100, a switching power supply unit using the coil component 1 with reduced number of steps required for assembling and of adequate insulation achieved can be obtained. In the case where the coil component 1 is applied to the main transformer 140, a transformer using the coil component 1 with reduced number of steps required for assembling and of adequate insulation achieved can be obtained.

While embodiments of the present invention have been described above, the present invention is not limited to the above embodiments and various modifications and alterations can naturally be made.

For example, the positions of the protrusions 34 and 36 provided to the first coil member 10 and the second coil member 12, respectively, may appropriately be changed. The number of the protrusions 34 and 36 may also be changed.

In the coil component 1 described in the above embodiments, it is described that two pieces of the coil windings 2 juxtaposed to each other are connected together via the connecting member 3, and their surfaces are covered with the resin portions 40. It is not necessary to use two pieces of the coil windings 2, and it may be constructed with a single piece of the coil winding 2 with its surface covered with the resin portion 40.

In the above embodiments, it is described that the outer perimeter edges of the protrusions 34 and 36 are covered with the resin portions 44 and 46, respectively, while the parts of the surfaces of the protrusions 34 and 36 are exposed. The resin portions 44 and 46 are provided to maintain the insulation properties when they contact other devices or the like and are not essential. In other words, the exposed parts are not limited to the parts of the surfaces of the protrusions 34 and 36, and their entire surfaces may be exposed as in the cases of the protrusions 33 and 35.

The form of the pair of magnetic core members 8 and 9 is not limited to a so-called UI-type where one of the magnetic core members, i.e. magnetic core member 8, has the leg portions 81 and 82 as illustrated in the above embodiment. For example, a so-called UU-type where both of the magnetic core members 8 and 9 have leg portions may be used, or an air-core configuration without having any leg portions 81 and 82 may also be used.

The number of coil members for the coil winding 2 only has to be two or more. In the case where a plurality of coil members are joined as in the present embodiments, when joining (when configuring the coil winding), it is preferable that, for example, as the difference in the disposed positions between the protrusion 34 and the protrusion 36, the protrusions provided to the respective coil members be at different positions from one another in an axis direction of the coil winding.

The configuration of the switching power supply unit is not limited to the one illustrated in FIGS. 9 and 10. In other words, the coil component 1 according to the present embodiment is suitably applied to, for example, an inverter. In addition, the application of the coil component 1 in the switching power supply unit 100 is not limited to the choke coil 70, and the coil component 1 may suitably be applied to the main transformer 140.

What is claimed is:

1. A coil component comprising:

a coil winding; and an insulating member having electrical insulation properties and integrally formed with the coil winding so as to cover a part of a surface of the coil winding, the coil component being sandwiched by magnetic core members in a direction of winding axis of the coil winding, wherein the coil winding is composed of a plurality of plate-like coil members in a ring shape having ends joined together in a stacking direction with a clearance therebetween so as to be continuous in a predetermined winding direction, the insulating member covers outermost plate surfaces of the coil members facing the magnetic core members, a space between the adjacent coil members, and inner perimeter edges of the coil members, and has a portion defining an opening along the direction of winding axis of the coil winding, each of the coil members is provided with a protrusion outwardly bulged at a position different from its terminal, such that a part of an outer perimeter edge thereof is larger in a radial direction, a part of a surface of the protrusion is exposed without being covered with the insulating member, at least a part of an outer perimeter edge of the protrusion is covered with the insulating member, circumferential positions of the protrusions provided to the plurality of coil members differ from one another, and the insulating member is provided with a convex portion configured to position the corresponding magnetic core member on one surface thereof facing the magnetic core member.

2. A transformer comprising the coil component as claimed in claim 1.

3. A switching power supply unit comprising the coil component as claimed in claim 1.

* * * * *